US005604076A

United States Patent [19]

Patel et al.

[11] Patent Number: 5,604,076

[45] Date of Patent: Feb. 18, 1997

[54] TONER COMPOSITIONS AND PROCESSES THEREOF

[75] Inventors: Raj D. Patel; Guerino G. Sacripante, both of Oakville; Grazyna E. Kmiecik-Lawrynowicz, Burlington; Michael A. Hopper, Toronto; Francisco E. Torres, Mississauga, all of Canada

[73] Assignee: Xerox Corporation, Stamford, Conn.

[21] Appl. No.: 595,143

[22] Filed: Feb. 1, 1996

[51] Int. Cl.[6] ..... G03G 9/087; G03G 9/097

[52] U.S. Cl. ..... 430/137

[58] Field of Search ..... 430/137, 110, 430/106

[56] References Cited

U.S. PATENT DOCUMENTS

| | | | |
|---|---|---|---|
| 4,137,188 | 1/1979 | Uetake et al. | 252/62.1 P |
| 4,983,488 | 1/1991 | Tan et al. | 430/137 |
| 4,996,127 | 2/1991 | Hasegawa et al. | 430/109 |
| 5,405,728 | 4/1995 | Hooper et al. | 430/137 |
| 5,529,719 | 6/1996 | Cunningham et al. | 430/137 |
| 5,549,998 | 8/1996 | Georges et al. | 430/137 |
| 5,554,480 | 9/1996 | Patel et al. | 430/137 |

*Primary Examiner*—John Goodrow
*Attorney, Agent, or Firm*—E. O. Palazzo

[57] ABSTRACT

A process for the preparation of toner compositions comprising:

(i) preparing a latex or emulsion resin comprised of a polyester core encapsulated within a styrene based resin shell by heating said polyester emulsion containing an anionic surfactant with a mixture of monomers of styrene and acrylic acid, and with potassium persulfate, ammonium persulfate, sodium bisulfite, or mixtures thereof;

(ii) adding a pigment dispersion, which dispersion is comprised of a pigment, a cationic surfactant, and optionally a charge control agent, followed by the sharing of the resulting blend;

(iii) heating the above sheared blend below about the glass transition temperature (Tg) of the resin to form electrostatically bound toner size aggregates with a narrow particle size distribution; and (iv) heating said electrostatically bound aggregates above about the Tg of the resin.

18 Claims, No Drawings

TONER COMPOSITIONS AND PROCESSES THEREOF

BACKGROUND OF THE INVENTION

This invention is generally directed to toner and developer compositions and processes thereof, and more specifically, the present invention is directed to developer and toner compositions and processes thereof containing a pigment, optionally a charge control agent and coalesced submicron particles, wherein the submicron particles are composed of a polyester core encapsulated by a styrene-acrylic acid resin shell.

In embodiments, the present invention is directed to the preparation of submicron particles comprised of a polyester core encapsulated by a styrene-acrylic acid resin by seed polymerization process, and the economical in situ chemical preparation of toners by the emulsion aggregation/coalescence process without the utilization of the known pulverization and/or classification methods, and wherein in embodiments toner compositions with an average volume diameter of from about 1 to about 25, and preferably from 1 to about 10 microns, and narrow GSD of, for example, from about 1.16 to about 1.26 as measured on the Coulter Counter can be obtained. The resulting toners can be selected for known electrophotographic imaging, printing processes, including color processes, and lithography. In embodiments, the present invention is directed to a process comprised of dispersing a pigment and optionally toner additives like a charge control agent or additive in an aqueous mixture containing an ionic surfactant in an amount of from about 0.5 percent (weight percent throughout unless otherwise indicated) to about 10 percent, and shearing this mixture with a latex of submicron composite particles comprised of a polyester core with a shell of a copolymer of styrene acrylate-acrylic acid of from, for example, about 0.01 micron to about 2 microns in volume average diameter, and which composite particles are obtained from the seed polymerization of monomers, such as acrylic acid, styrene and or methacrylates, a polymerization initiator and a polyester submicron particle comprised of, for example, poly(propylene-terephthalate) or poly(propoxylated bisphenol A-fumarate), in an aqueous solution containing a counterionic surfactant in amounts of from about 1 percent to about 10 percent with opposite charge to the ionic surfactant of the pigment dispersion, and nonionic surfactant in amounts of from about 0 percent to about 5 percent, thereby causing a flocculation of composite particles, pigment particles and optional charge control agent, followed by heating at about 5 to about 40° C. below the shell Tg and preferably about 5 to about 25° C. below the shell Tg while stirring of the flocculent mixture which is believed to form statically bound aggregates of from about 1 micron to about 10 microns in volume average diameter comprised of modified polyester resin, pigment and optionally charge control particles, and thereafter heating the formed bound aggregates about above the Tg (glass transition temperature) of the composite particle. The size of the aforementioned statistically bonded aggregated composite particles can be controlled by adjusting the temperature in the below the resin Tg heating stage. Thus, for example, an increase in the temperature causes an increase in the size of the aggregated particle. This process of aggregating composite particles and pigment particles is kinetically controlled, that is the temperature increases the process of aggregation. The higher the temperature during stirring the quicker the aggregates are formed, for example from about 2 to about 10 times faster in embodiments, and the latex submicron particles are picked up more quickly. The temperature also controls in embodiments the particle size distribution of the aggregates, for example the higher the temperature the narrower the particle size distribution, and this narrower distribution can be achieved in, for example, from about 0.5 to about 24 hours and preferably in about 1 to about 3 hours time. Heating the mixture about above or in embodiments equal to the resin Tg generates toner particles with, for example, an average particle volume diameter of from about 1 to about 25 and preferably 10 microns. It is believed that during the heating stage the components of aggregated composite particle shell fuse together to form composite toner particles. In another embodiment thereof, the present invention is directed to an in situ process comprised of first dispersing a pigment, such as HELIOGEN BLUE™ or HOSTAPERM PINK™, in an aqueous mixture containing a cationic surfactant, such as benzalkonium chloride (SANIZOL B-50™), utilizing a high shearing device, such as a Brinkmann Polytron, microfluidizer or sonicator, thereafter shearing this mixture with a latex of suspended particles of monomers of acrylic acid and styrene, and which latex also contains a polyester resin, and which particles are, for example, of a size ranging from about 0.01 to about 0.5 micron in volume average diameter as measured by the Brookhaven nanosizer in an aqueous surfactant mixture containing an anionic surfactant, such as sodium dodecylbenzene sulfonate (for example NEOGEN R™ or NEOGEN SC™), and a nonionic surfactant, such as alkyl phenoxy poly(ethylenoxy)ethanol (for example IGEPAL 897™ or ANTAROX 897™), thereby resulting in a flocculation, or heterocoagulation of the formed composite particles comprised of a polyester with a shell thereover of a copolymer of styrene-acrylic acid with the pigment particles; and which, on further stirring for about 1 to about 3 hours while heating, for example, from about 35° to about 45° C., results in the formation of statically bound aggregates ranging in size of from about 0.5 micron to about 10 microns in average diameter size as measured by the Coulter Counter (Microsizer II), where the size of those aggregated particles and their distribution can be controlled by the temperature of heating, for example from about 5° to about 25° C. below the resin Tg, and where the speed at which toner size aggregates are formed can also be controlled by the temperature. Thereafter, heating from about 5° to about 50° C. above the resin Tg provides for particle fusion or coalescence of the polymer and pigment particles; followed by optional washing with, for example, hot, for example at a temperature of from about 50° to about 90° C., water to remove surfactant, and drying whereby toner particles comprised of resin and pigment with various particle size diameters can be obtained, such as from 1 to about 20, and preferably 12 microns in average volume particle diameter. The aforementioned toners are especially useful for the development of colored images with excellent line and solid resolution, and wherein substantially no background deposits are present.

While not being desired to be limited by theory, it is believed that the flocculation or heterocoagulation is caused by the neutralization of the pigment mixture containing the pigment and ionic, such as cationic, surfactant absorbed on the pigment surface with the resin mixture containing the polyester resin particles and anionic surfactant absorbed on the resin particle. This process is kinetically controlled and an increase of, for example, from about 25° C. to about 45° C. of the temperature increases the flocculation, increasing from about 2.5 to 6 microns the size of the aggregated particles formed, and with a GSD charge of from about 1.39 to about 1.20 as measured on the Coulter Counter; the GSD is thus narrowed down since at high 45° C. to 55° C. (5° C. to 10° C. below the resin Tg) temperature the mobility of the particles increases, and as a result all the fines and submicron size particles are collected much faster, for example 14 hours as opposed to 2 hours, and more efficiently. Thereafter, heating the aggregates, for example, from about 5° C. to about 80° C. above the resin Tg fuses the aggregated particles or coalesces the particles to enable the formation of toner composites of modified polyester polymer, pigments and optional toner additives like charge control agents, and the like, such as waxes. Furthermore, in other embodiments the ionic surfactants can be exchanged, such that the pigment mixture contains the pigment particle and anionic surfactant, and the suspended resin particle mixture contains the resin particles and cationic surfactant; followed by the ensuing steps as illustrated herein to enable flocculation by charge neutralization while shearing, and thereby forming statically bounded aggregate particles by stirring and heating below the resin Tg; and thereafter, that is when the aggregates are formed, heating above the resin Tg to form stable toner composite particles. Of importance with respect to the processes of the present invention in embodiments is computer controlling the temperature of the heating to form the aggregates since the temperature can affect the rate of aggregation, the size of the aggregates and the particle size distribution of the aggregates. More specifically, the formation of aggregates is much faster, for example 6 to 7 times, when the temperature is 20° C. higher than room temperature, about 25° C., and the size of the aggregated particles, from 2.5 to 6 microns, increases with an increase in temperature. Also, an increase in the temperature of heating from room temperature to 45° C. improves the particle size distribution, for example with an increase in temperature below the resin Tg, the particle size distribution, believed due to the faster collection of submicron particles, improves significantly. The latex blend or emulsion is comprised of resin or polymer, counterionic surfactant, and nonionic surfactant.

In reprographic technologies, such as xerographic and ionographic devices, toners with average volume diameter particle sizes of from about 9 microns to about 20 microns are effectively utilized. Moreover, in some xerographic technologies, such as the high volume Xerox Corporation 5090 copier-duplicator, high resolution characteristics and low image noise are highly desired, and can be attained utilizing the small sized toners of the present invention with, for example, an average volume particle of from about 2 to about 11 microns and preferably less than about 7 microns, and with narrow geometric size distribution (GSD) of from about 1.16 to about 1.3. Additionally, in some xerographic systems wherein process color is utilized, such as pictorial color applications, small particle size colored toners, preferably of from about 3 to about 9 microns, are highly desired to avoid paper curling. Paper curling is especially observed in pictorial or process color applications wherein three to four layers of toners are transferred and fused onto paper. During the fusing step, moisture is driven off from the paper due to the high fusing temperatures of from about 130° to 160° C. applied to the paper from the fuser. Where only one layer of toner is present, such as in black or in highlight xerographic applications, the amount of moisture driven off during fusing can be reabsorbed proportionally by paper and the resulting print remains relatively flat with minimal curl. In pictorial color process applications wherein three to four colored toner layers are present, a thicker toner plastic level present after the fusing step can inhibit the paper from sufficiently absorbing the moisture lost during the fusing step, and image paper curling results. Furthermore, toners with low minimum fixing temperature are desired to, for example, reduce the energy requirements of the printers and copiers, and to further extend the lifetime of the fuser rolls. In addition, nonvinyl offset properties and low relative humidity sensitivity are needed for toners. For certain xerographic properties, such as low minimum fixing temperature, nonvinyl offset characteristics, and high gloss properties, polyester resins, are known to be advantageous in comparison to styrene based resins. In contrast, styrene based toner resins are advantages in comparison to polyester resin for certain properties such as low relative humidity sensitivity, high blocking temperatures and in unit manufacturing cost.

These and other advantages are attained with the toners and processes of the present invention, and more specifically, by designing toner compositions comprised of both a polyester resin and styrene based resin, wherein the styrene base resin encapsulates the polyester resin such that the surface characteristics of the toner are directed by the encapsulant component, such as polystyrene-acrylic acid, and which encapsulant is responsible for the toners excellent blocking temperatures, triboelectric characteristics and RH-sensitivity provided by the acid residual, and wherein the core is comprised of a polyester which possesses a low minimum fixing temperature, such as from about 125° C. to about 145° C., high gloss properties, such as from about 40 to about 80 gloss units as measured by the Garner gloss metering unit, and excellent nonvinyl offset performance. These toner compositions can be prepared by emulsion aggregation and coalescence process resulting in small toner particle sizes, such as from about 1 to 7 microns, with narrow size distribution such as from about 1.15 to about 1.3 and high yields such as from about 97 to about 100 percent by weight, and with higher pigment loading such as from about 5 to about 12 percent by weight of toner, such that the mass of toner layers deposited onto paper is reduced to obtain the same quality of image and resulting in a thinner plastic toner layer on paper after fusing, thereby minimizing or avoiding paper curling.

Toners prepared in accordance with the present invention enable in embodiments the use of lower image fusing temperatures, such as from about 120° C. to about 150° C., thereby avoiding or minimizing paper curl. Lower fusing temperatures minimize the loss of moisture from paper, thereby reducing or eliminating paper curl. Furthermore, in process color applications and especially in pictorial color applications, toner to paper gloss matching is highly desirable. Gloss matching is referred to as matching the gloss of the toner image to the gloss of the paper. For example, when a low gloss image of preferably from about 1 to about 30 gloss is desired, low gloss paper is utilized, such as from about 1 to about 30 gloss units as measured by the Gardner Gloss metering unit, and which after image formation with small particle size toners, preferably of from about 3 to about 5 microns, and fixing thereafter results in a low gloss toner image of from about 1 to about 30 gloss units as measured by the Gardner Gloss metering unit. Alternatively, when higher image gloss is desired, such as from about 30 to about 60 gloss units as measured by the Gardner Gloss metering unit, higher gloss paper is utilized, such as from about 30 to about 60 gloss units, and which after image formation with small particle size toners of the present invention of preferably from about 3 to about 5 microns, and fixing thereafter results in a higher gloss toner image of from about 30 to about 60 gloss units as measured by the Gardner Gloss metering unit. The aforementioned toner to paper matching can be attained with small particle size toners such as less than 7 microns and preferably less than 5 microns, such as from about 1 to about 4 microns, whereby the pile height of the toner layer or layers is considered low and acceptable.

Numerous processes are known for the preparation of toners, such as, for example, conventional processes wherein a resin is melt kneaded or extruded with a pigment, micronized and pulverized to provide toner particles with an average volume particle diameter of from about 9 microns to about 20 microns and with broad geometric size distribution of from about 1.4 to about 1.7. In these processes, it is usually necessary to subject the aforementioned toners to a classification procedure such that the geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields can be obtained after classification, such as from about 50 percent to about 70 percent. With the processes of the present invention in embodiments, small average particle sizes of, for example, from about 3 microns to about 9, and preferably 5 microns, are attained without resorting to classification processes, and wherein narrow geometric size distributions are attained, such as from about 1.16 to about 1.30, and preferably from about 1.16 to about 1.25. High toner yields are also attained, such as from about 90 percent to about 98 percent, in embodiments of the present invention. In addition, by the toner particle preparation process of the present invention in embodiments, small particle size toners of from about 3 microns to about 7 microns can be economically prepared in high yields, such as from about 90 percent to about 98 percent by weight based on the weight of all the toner material ingredients, such as toner resin and pigment.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, however, the emulsion particles are not comprised of a polyester core with styrene-acrylic acid shell. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed to the use of coagulants, such as inorganic magnesium sulfate, which results in the formation of particles with a wide GSD. Furthermore, the '488 patent does not, it appears, disclose the use of emulsion particles comprised of polyester core with styrene-acrylic acid shell.

Other prior art that may be of interest includes U.S. Pat. Nos. 3,674,736; 4,137,188 and 5,066,560.

Moreover, there is disclosed in U.S. Pat. No. 5,302,486, encapsulated toner composition comprised of a core and shell thereover, wherein these toners are prepared by a process which comprises microsuspending a mixture of a pigment, an organic phase such as a polyester resin A, and an olefinic monomer which after heating is polymerized to resin B, and wherein the incompatible resin A and resin B phase separate to whereby a core and shell results. However, with this microsuspension process, every toner particle is comprised of a shell encapsulating a core, whereas in the present invention, the toner particles are comprised of a multitude of smaller emulsion particles comprised of a shell and core, and wherein the shell material is coalesced to form the intact particle as illustrated therein, and which provide excellent pigment dispersion. Furthermore, the process of the present invention does not comprise a free-radical polymerization step as does the 486 patent, where it is known to adversely affect changes in color pigmentation due to the reaction of a radical and pigment.

The process described in the present application has several advantages as indicated herein including in embodiments the effective preparation of small toner particles with narrow particle size distribution as a result of no classification with high yields of toner, and which toners are comprised of pigment and coalesced particles of polyester core with styrene acrylic acid shell resulting in marking materials with superior performances such as nonvinyl offset, low minimum fusing temperature, excellent blocking and low relative humidity.

SUMMARY OF THE INVENTION

Examples of objects of the present invention in embodiments include:

It is an object of the present invention to provide toner processes with many of the advantages illustrated herein.

In another object of the present invention there are provided simple and economical processes for the direct preparation of black and colored toner compositions with, for example, excellent pigment dispersion and narrow GSD.

In a further object of the present invention there is provided a toner composition and process thereof, and which toner contains a pigment, optionally a charge control agent and coalesced submicron particles, for example 0.01 to about 1, wherein the submicron particles are composed of a polyester core encapsulated by a styrene-acrylic acid resin shell.

In yet another object of the present invention there is provided the preparation of submicron particles of from about 20 to about 200 nanometers comprised of a polyester core and encapsulated by a styrene-acrylic acid resin by seed polymerization process.

In a further object of the present invention there is provided a process for the preparation of toner compositions with certain effective particle sizes by controlling the temperature of the aggregation which comprises stirring and heating about below the resin glass transition temperature (Tg).

In a further object of the present invention there is provided a process for the preparation of toners with particle size distribution which can be improved from 1.4 to about 1.16 as measured by the Coulter Counter by increasing the temperature of aggregation from about 25° C. to about 45° C.

In a further object of the present invention there is provided a process that is rapid as, for example, the aggregation time can be reduced to below 1 to 3 hours by increasing the temperature from room, about 25° C., temperature (RT) to a temperature below 5° C. to 20° C. Tg and wherein the process consumes from about 2 to about 8 hours.

Moreover, in a further object of the present invention there is provided a process for the preparation of toner compositions which after fixing to paper substrates results in images with a gloss of from 20 GGU (Gardner Gloss Units) up to 70 GGU as measured by Gardner Gloss meter matching of toner and paper.

In another object of the present invention there is provided a composite toner of polymeric resin with pigment and optional charge control agent in high yields of from about 90 percent to about 100 percent by weight of toner without resorting to classification.

In yet another object of the present invention there are provided toner compositions with low fusing temperatures, that is low melting toners, of from about 130° C. to about 150° C. and with excellent blocking characteristics at from about 120° F. to about 130° F.

Moreover, in another object of the present invention there are provided toner compositions with a high projection efficiency, such as from about 75 to about 95 percent efficiency as measured by the Match Scan II spectrophotometer available from Milton-Roy.

In a further object of the present invention there are provided toner compositions which result in minimal, low or no paper curl.

Another object of the present invention relates to the in situ preparation of polyester resin based toners by emulsion aggregation processes wherein a polyester is selected as a seed which can then be modified by grafting, or otherwise attaching thereto acrylic acid and persulfite initiator derived ionic groups onto the polyester surface to provide the required colloidal and surface properties to enable aggregation and coalescence.

These and other objects of the present invention are accomplished in embodiments by the provision of toners and processes thereof. In embodiments of the present invention, there are provided processes for the economical direct preparation of toner compositions by improved flocculation or heterocoagulation, and coalescence and wherein the temperature of aggregation can be utilized to control the final toner particle size, that is volume average diameter.

In embodiments, the present invention relates to a process for the preparation of an emulsion resin comprised of a styrene-methacrylate-acrylic acid shell and polyester core. This is achieved in embodiments by first preparing a polyester emulsion resin in water as illustrated, for example in U.S. Pat. No. 5,348,832, the disclosure of which is totally incorporated herein by reference, wherein a sulfo-polyester resin is spontaneously emulsified in water by heating at about 10° to about 30° C. above the glass transition temperature of the sulfo-polyester resin. Alternatively, the polyester emulsion can be prepared, for example, as illustrated in U.S. Pat. No. 5,290,654, the disclosure of which is totally incorporated herein by reference, wherein a polyester resin is dissolved in a low boiling organic solvent, microsuspended in an aqueous mixture of anionic and nonionic surfactants, followed by removing the organic solvent by heating. To the corresponding mixture of suspended emulsion particles in water is then added a mixture of free radical initiators, such as persulfates or persulfites like potassium persulfate and sodium bisulfite, followed by the addition of olefinic monomers such as styrene, acrylic acid or methacrylic acid and/or alkyl acrylates, alkyl methacrylates, or butadiene, thereby resulting in the seed polymerization of a styrene-based polymer on the polyester emulsion seed particles and resulting in a latex comprised of emulsion particles containing a polyester core encapsulated with a styrene-acrylic acid based shell.

The toner can be prepared by the following steps:

(i) preparing a pigment dispersion in water, which dispersion is comprised of a pigment, an ionic surfactant and optionally a charge control agent;

(ii) shearing the pigment dispersion with a latex blend comprised of resin particles comprised of a polyester core and styrene-acrylic acid shell, a counterionic surfactant with a charge polarity of opposite sign to that of said ionic surfactant and a nonionic surfactant thereby causing a flocculation or heterocoagulation of the formed particles of pigment, resin and charge control agent to form a uniform dispersion of solids;

(iii) heating, for example, from about 35° C. to about 50° C. the sheared blend at temperatures below the about or equal resin Tg, for example from about 5° C. to about 20° C., while continuously stirring to form electrostatically bounded relatively stable (for Coulter Counter measurements) toner size aggregates with narrow particle size distribution;

(iv) heating, for example from about 60° C. to about 95° C., the statically bound aggregated particles at temperatures of about 5° C. to 50° C. above the resin Tg wherein the resin Tg is in the range of about 50° C., and preferably 52° C. to about 65° C. to enable a mechanically stable, morphologically useful form of said toner composition comprised of polymeric resin, pigment and optionally a charge control agent;

(v) separating the toner particles from the water by filtration; and (vi) drying the toner particles.

In embodiments, the heating in (iii) is accomplished at a temperature of from about 29° C. to about 59° C.; the resin Tg in (iii) is from about 50° C. to about 80° C.; heating in (iv) is from about 5° C. to about 50° C. above the Tg; and wherein the resin Tg in (iv) is from about 50° C. to about 80° C.

Embodiments of the present invention include a process for the preparation of toner compositions consisting essentially of:

(i) preparing a pigment dispersion, which dispersion is comprised of a pigment, an ionic surfactant, and optionally a charge control agent;

(ii) shearing said pigment dispersion with a latex or emulsion resin comprised of a polyester core encapsulated with a styrene based resin shell, a counterionic surfactant with a charge polarity of opposite sign to that of the ionic surfactant and a nonionic surfactant, and which latex contains an initiator such as a persulfate or persulfite;

(iii) heating the above sheared blend below about the glass transition temperature (Tg) of the composite resin, to form electrostatically bound toner size aggregates with a narrow particle size distribution; and (iv) heating the electrostatically bound aggregates above about the Tg of the resin and wherein coalescence is accomplished; a process for the preparation of toner compositions comprising:

(i) preparing a pigment dispersion, which dispersion is comprised of a pigment, and an ionic surfactant;

(ii) shearing said pigment dispersion with a latex resin comprised of a polyester core encapsulated with a styrene based resin shell, a counterionic surfactant with a charge polarity of opposite sign to that of the ionic surfactant, and a nonionic surfactant, and which latex contains an initiator such as a persulfate or persulfite;

(iii) heating the above sheared blend below the glass transition temperature (Tg) of the resin;

(iv) heating above the Tg of the resin and subsequently cooling and isolating by, for example, filtration the toner compositions; and in embodiments wherein the styrene resin is selected from the group consisting of polystyrene, polystyrene-butadiene, polystyrene-isoprene, polystyrene-butadiene-acrylic acid, polystyrene-acrylate, polystyrene-methacrylate, and polystyrene-(meth)acrylate-acrylic acid, and the polyester is selected from the group consisting of poly(ethylene-terephthalate), poly(propylene-diethylene terephthalate), poly(propylene-terephthalate), copoly(propylene-diethylene terephthalate)copoly(propylene-5-sulfoisophthalate, sodium salt), poly(bisphenol A-fumarate), poly(bisphenol A-terephthalate), copoly-(bisphenol A-terephthalate-copoly(bisphenol A-fumarate), poly(hexylene terephthalate), poly(neopentyl-terephthalate), and copoly(neopentyl-terephthalate)-copoly-(neopentyl-5-sulfoisophthalate); wherein heating the electrostatically bound aggregates above about the Tg is accomplished at a temperature of from about 40° C. to about 70° C.; and wherein the toner resulting is of a volume average diameter of from about 5 to about 15 microns.

Embodiments of the present invention include a process for the preparation of toner compositions comprising:

(i) preparing a latex or emulsion resin comprised of a polyester core encapsulated within a styrene based resin shell by heating said polyester emulsion containing an anionic surfactant with a mixture of monomers of styrene and acrylic acid, and with potassium, persulfate, ammonium persulfate, sodium bisulfite, or mixtures thereof;

(ii) adding a pigment dispersion, which dispersion is comprised of a pigment, a cationic surfactant, and optionally a charge control agent, followed by the sharing of the resulting blend;

(iii) heating the above sheared blend below about the glass transition temperature (Tg) of the resin to form electrostatically bound toner size aggregates with a narrow particle size distribution; and (iv) heating said electrostatically bound aggregates above about the Tg of the resin; a process for the preparation of a toner comprising:

(i) preparing a latex or emulsion resin comprised of a polyester core encapsulated within a styrene resin shell by heating said polyester emulsion containing an anionic surfactant with a mixture of monomers of styrene and acrylic acid in the presence of ammonium persulfate, potassium persulfate and sodium bisulfite;

(ii) adding a pigment dispersion, which dispersion is comprised of a pigment, a cationic surfactant, and optionally a charge control agent;

(iii) heating the resulting blend below the glass transition temperature (Tg) of the resin to form toner size aggregates; and (iv) heating said aggregates above the glass transition temperature (Tg) of the resin; followed by cooling and isolating the toner; and a process for the preparation of a toner comprising:

(i) preparing a latex or emulsion resin comprised of a polyester core encapsulated within a styrene resin shell by heating said polyester emulsion containing an anionic surfactant with a mixture of monomers of styrene and acrylic acid in the presence of persulfate or persulfite;

(ii) adding a pigment dispersion, which dispersion is comprised of a pigment, a cationic surfactant, and optionally a charge control agent;

(iii) heating the resulting blend below the glass transition temperature (Tg) of the resin to form toner size aggregates; and (iv) heating said aggregates above the glass transition temperature (Tg) of the resin; followed by cooling and isolating the toner.

Illustrative examples of olefinic monomers include acrylic acid, styrene, methacrylate, and methacrylic acid. The monomers selected, which generally can be in embodiments styrene acrylates, styrene butadienes, styrene methacrylates, or polyesters, are present in various effective amounts, such as from about 85 weight percent to about 98 weight percent of the toner, and can be of small average particle size, such as from about 0.01 micron to about 1 micron in average volume diameter as measured by the Brookhaven nanosize particle analyzer. Other sizes and effective amounts of resin particles may be selected in embodiments, for example copolymers of poly(styrene butylacrylate acrylic acid) or poly(styrene butadiene acrylic acid).

Examples of polyesters present in an amount of from about 80 to about 98 percent by weight of the toner composite comprised of pigment and particles of polyester core and styrene based shell are as illustrated herein, and more specifically, polyesters include the esterification products of a dicarboxylic acid and a diol comprising a diphenol. These resins are illustrated in U.S. Pat. Nos. 3,590,000; 5,348,832 and 5,290,654, the disclosure of which is totally incorporated herein by reference. Other polyesters can be obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol. Also, waxes present in an amount of from about 1 to about 5 percent by weight of toner can be selected with a molecular weight of from about 1,000 to about 7,000, such as polyethylene, polypropylene, and paraffin waxes, can be included in, or on the toner compositions as fuser roll release agents.

Various known colorants or pigments present in the toner in an effective amount of, for example, from about 1 to about 25 percent by weight of the toner, and preferably in an amount of from about 1 to about 15 weight percent, that can be selected include carbon black like REGAL 330®; magnetites, such as Mobay magnetites MO80297™, MO8060198 ; Columbian magnetites; MAPICO BLACKS™ and surface treated magnetites; Pfizer magnetites CB4799™, CB5300™, CB5600™, MCX6369T™; Bayer magnetites, BAYFERROX 86007™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include those as recited in the Color Index such as phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E. D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The pigments selected are present in various effective amounts, such as from about 1 weight percent to about 65 weight and preferably from about 2 to about 12 percent, of the toner.

Surfactants in amounts of, for example, 0.1 to about 25 weight percent in embodiments include, for example, nonionic surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example from about 0.01 to about 10 percent by weight, and preferably from about 0.1 to about 5 percent by weight of monomers, used to prepare the copolymer resin.

Examples of ionic surfactants include anionic and cationic with examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 10 percent by weight, and preferably from about 0.1 to about 5 percent by weight of monomers used to prepare the copolymer resin particles of the emulsion or latex blend.

Examples of the cationic surfactants, which are usually positively charged, selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (alkyl benzalkonium chloride), available from Kao Chemicals, and the like, and mixtures thereof. This surfactant is utilized in various effective amounts, such as for example from about 0.1 percent to about 5 percent by weight of water. Preferably, the molar ratio of the cationic surfactant used for flocculation to the anionic surfactant used in the latex preparation is in the range of from about 0.5 to 4, and preferably from 0.5 to 2.

Counterionic surfactants are comprised of either anionic or cationic surfactants as illustrated herein and in the amount indicated, thus, when the ionic surfactant of step (i) is an anionic surfactant, the counterionic surfactant is a cationic surfactant.

Examples of the surfactant, which are added to the aggregated particles to "freeze" or retain particle size, and GSD achieved in the aggregation can be selected from the anionic surfactants such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. They can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the anionic or nonionic surfactant generally employed as a "freezing agent" or stabilizing agent is, for example, from about 0.01 to about 10 percent by weight, and preferably from about 0.5 to about 5 percent by weight of the total weight of the aggregated component comprised of resin latex, pigment particles, water, ionic and nonionic surfactants mixture.

Surface additives that can be added to the toner compositions after washing or drying include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent which can be added during the aggregation process or blended into the formed toner.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,660, the disclosure of which is totally incorporated herein by reference.

The present invention in embodiments includes selecting a polyester emulsion as a seed, which can be modified by attaching, for example by grafting, acrylic acid and initiator, such as a persulfate, ionic groups, onto the polyester surface thereby providing colloidal and surface properties to permit emulsion/aggregation/coalescence thereof as illustrated, for example, in U.S. Pat. Nos. 5,370,963; 5,344,738; 5,403,693; 5,418,108; 5,364,729 and 5,405,728, the disclosures of which are totally incorporated herein by reference. Chain transfer agents, such as dodecanethiol, and mixtures of initiators, such as persulfates and persulfites, can be selected for the processes of the present invention in embodiments thereof.

The following Examples are being submitted to further define various species of the present invention. These Examples are intended to be illustrative only and are not intended to limit the scope of the present invention. Also, parts and percentages are by weight unless otherwise indicated.

EXAMPLE I

A polyester emulsion comprised of copoly(1,2-propylene-terephthalate)-copoly(1,2-propylene-5-sulfoisophthalate) wherein the sulfonated monomer represents 7.5 mole percent equivalent of the polyester resin was prepared as follows.

To a 20 liter Parr reactor equipped with a magnetic stirrer, distillation apparatus, and a bottom drain valve were charged 1.649 kilograms of dimethylterephthalate, 1.52 kilograms of 1,2-propanediol, 444 grams of dimethyl 5-sulfoisophthalate-sodium salt, and 5 grams of butylstannoic acid catalyst. The mixture was heated in the reactor to 165° C. and stirred at 200 rpm for one hour. The reactor temperature was then increased slowly to 190° C. over a five hour period, during which time methanol was collected in the distillation receiver. The mixture was then heated to 200° C. and vacuum was applied from atmospheric pressure to 1 Torr over a two hour period, during which time 1,2-propanediol was collected in the distillation receiver. The temperature was then raised slowly to 220° C., and the vacuum decreased to 0.2 Torr over a one hour period. The reactor was then repressurized to atmospheric pressure, and the product (about 2 kilograms) was discharged through the bottom drain valve. The copoly(1,2-propylene-terephthalate)-copoly(1,2-propylene-5-sulfoisophthalate) resin product was analyzed for its glass transition temperature using the DuPont Differential Scanning calorimeter at a heating rate of 10° C. per minute, and the glass transition temperature was a measured 50° C.

An emulsion latex was then prepared by heating about 100 grams of the above polyester resin in about 400 milliliters of water at a temperature of about 75° C. for a duration of about 30 minutes with stirring to provide a latex of about 20 weight percent of solids (comprised of polyester particles) by weight of the latex.

EXAMPLE II

An emulsion latex composite containing 10 percent by weight of shell comprised of styrene-methacrylate-acrylic acid and 90 percent by weight of a polyester core comprised of the copoly(1,2-propylene-terephthalate)-copoly(1,2-propylene-5-sulfoisophthalate) of Example I was prepared as follows.

To about 500 grams of the latex of Example I were added 0.2 gram of potassium persulfate, 0.2 gram of sodium bisulfite, 9 grams of sodium dodecyl benzene sulfonate anionic surfactant (NEOGEN R™ which contains 60 percent of active component), 8.6 grams of polyoxyethylene nonyl phenyl ether - non ionic surfactant (ANTAROX 897™) followed by the dropwise addition of 16 grams of styrene, 3.3 grams of n-butylmethacrylate, 0.2 gram of dodecanethiol and 0.8 gram of acrylic acid utilizing a syringe pump over a two hour period at about 25° C. The mixture was then stirred for an additional 6 hours. The zeta potential as measured on Pen Kem Inc. Laser Zee Meter was −80 millivolts for the polymeric latex. The particle size of the latex as measured on Brookhaven BI-90 Particle Nanosizer was 147 nanometers.

EXAMPLE III

Preparation of a toner composition comprised of 4 percent by weight of PV FAST BLUE™ pigment, and 96 percent by weight of a composite resin comprised of 10 percent by weight of shell comprised of styrene-methacrylate-acrylic acid and 90 percent by weight of a polyester core comprised of the copoly(1,2-propylene-terephthalate)-copoly(1,2-propylene-5-sulfoisophthalate) of Example II.

A pigment dispersion comprised of 4 grams of dry pigment PV FAST BLUE™ and 1 gram of cationic surfactant SANIZOL B-50™ dispersed in 400 grams of water was obtained using an ultrasonic probe. The aforementioned pigment dispersion was then sheared for 3 minutes at 10,000 rpm. 520 Grams of the latex of Example II was then added while shearing. Shearing was continued for an additional 8 minutes at 10,000 rpm. 500 Grams of the resulting blend were than transferred into a kettle placed in the heating mantle and equipped with mechanical stirrer and temperature probe. The temperature of the mixture was raised from 25° C. (room temperature) to 45° C., and left stirring for 24 hours. 40 Milliliters of a 20 percent solution of anionic surfactant (NEOGEN R™) were then added while stirring prior to raising the temperature of the aggregated particles in the kettle to 80° C. The heating was continued at 80° C. for 3 hours to coalesce the aggregated particles. No change in the particle size and the GSD was observed, compared to the size of the aggregates. The particles were filtered, washed using hot deionized water, and dried on the freeze dryer. The resulting cyan toner was comprised of 96 percent of resin and 4 percent of PV FAST BLUE™pigment. Toner aggregates particle size as measured on the Coulter Counter after 1 hour and 24 hours was 7 microns average volume diameter, and the GSD was 1.25.

EXAMPLE IV

Preparation of a toner composition comprised of 5 percent by weight of FANAL PINK™ pigment, and 95 percent by weight of a composite resin comprised of 10 percent by weight of shell comprised of styrene-methacrylate-acrylic acid and 90 percent by weight of a polyester core comprised of the copoly(1,2-propylene-terephthalate)-copoly(1,2-propylene-5-sulfoisophthalate) of Example II.

A pigment dispersion comprised of 4 grams of dry FANAL PINK™ and 1 gram of cationic surfactant SANIZOL B-50™ dispersed in 400 grams of water was obtained using an ultrasonic probe. The aforementioned pigment dispersion was then sheared for 3 minutes at 10,000 rpm. 520 Grams of the latex of Example II were then added while shearing. Shearing was continued for an extra 8 minutes at 10,000 rpm. 500 Grams of this blend were than transferred into a kettle placed in the heating mantle and equipped with mechanical stirrer and temperature probe. The temperature of the mixture was raised from 25° C. (room temperature) to 45° C., and left stirring for 24 hours. 40 Milliliters of a 20 percent solution of anionic surfactant (NEOGEN R™) were then added while stirring prior to raising the temperature of the aggregated particles in the kettle to 80° C. The heating was continued at 75° C. for 3 hours to coalesce the aggregated particles. No change in the particle size and the GSD was observed compared to the size of the aggregates. The particles were filtered, washed using hot deionized water, and dried on the freeze dryer. The resulting cyan toner was comprised of 96 percent of resin and 4 percent of PV FAST BLUE™ pigment. Toner aggregates particle size as measured on the Coulter Counter after 1 hour and 24 hours was 5.2 microns average volume diameter, and the GSD was 1.23.

EXAMPLE V

Preparation of a toner composition comprised of 5 percent by weight of REGAL 330™ black pigment, and 95 percent by weight of a composite resin comprised of 10 percent by weight of shell comprised of styrene-methacrylate-acrylic acid and 90 percent by weight of a polyester core comprised of the copoly(1,2-propyleneterephthalate)-copoly(1,2-propylene-5-sulfoisophthalate) of Example II.

A pigment dispersion comprised of 4 grams of dry REGAL 330™ and 1 gram of cationic surfactant SANIZOL B-50™dispersed in 400 grams of water was obtained using an ultrasonic probe. The aforementioned pigment dispersion was then sheared for 3 minutes at 10,000 rpm. 520 Grams of the latex of Example II were then added while shearing. Shearing was continued for an extra 8 minutes at 10,000 rpm. 500 Grams of this blend were than transferred into a kettle placed in the heating mantle and equipped with mechanical stirrer and temperature probe. The temperature of the mixture was raised from 25° C. (room temperature) to 45° C., and left stirring for 24 hours. 40 Milliliters of a 20 percent solution of anionic surfactant (NEOGEN R™) were then added while stirring prior to raising the temperature of the aggregated particles in the kettle to 80° C. The heating was continued at 70° C. for 3 hours to coalesce the aggregated particles. No change in the particle size and the GSD was observed compared to the size of the aggregates. The particles were filtered, washed using hot deionized water, and dried on the freeze dryer. The resulting cyan toner was comprised of 96 percent of resin and 4 percent of PV FAST BLUE™ pigment. Toner aggregates particle size as measured on the Coulter Counter after 1 hour and 24 hours was 3.5 microns average volume diameter, and the GSD was 1.26.

Other embodiments and modifications of the present invention may occur to those of ordinary skill in the art subsequent to a review of the present application and the information presented herein; these embodiments and modifications, as well as equivalents thereof, are also included within the scope of this invention.

What is claimed is:

1. A process for the preparation of toner compositions comprising:

(i) preparing a latex or emulsion resin comprised of a polyester core encapsulated within a styrene based resin shell by heating said polyester emulsion containing an anionic surfactant with a mixture of monomers of styrene and acrylic acid, and with potassium persulfate, ammonium persulfate, sodium bisulfite, or mixtures thereof;

(ii) adding a pigment dispersion, which dispersion is comprised of a pigment, a cationic surfactant, and optionally a charge control agent, followed by the sharing of the resulting blend;

(iii) heating the above sheared blend below about the glass transition temperature (Tg) of the resin to form electrostatically bound toner size aggregates with a narrow particle size distribution; and (iv) heating said electrostatically bound aggregates above about the Tg of the resin.

2. A process in accordance to claim 1 wherein the styrene based resin is selected from the group consisting of polystyrene-acrylic acid, and polystyrene-methacrylic acid.

3. A process in accordance to claim 1 wherein the polyester is selected from the group consisting of poly(ethylene-terephthalate), poly(propylene-diethylene terephthalate), poly(propylene-terephthalate), copoly(propylene-diethylene terephthalate)-copoly(propylene-5-sulfoisophthalate, sodium salt), poly(bisphenol A-fumarate), poly(bisphenol A-terephthalate), copoly(bisphenol A-terephthalate)-copoly(bisphenol A-fumarate), poly(hexylene terephthalate), poly(neopentyl-terephthalate), and copoly(neopentyl-terephthalate)-copoly-(neopentyl-5-sulfoisophthalate).

4. A process in accordance with claim 1 wherein heating said electrostatically bound aggregates above about the Tg is accomplished at a temperature of from about 40° C. to about 70° C.

5. A process in accordance with claim 1 wherein the toner is of a volume average diameter of from about 5 to about 15 microns.

6. A process in accordance with claim 1 wherein the anionic surfactant is an ionic surfactant selected from the group consisting of ammonium lauryl sulfate, sodium dodecyl sulfate, dodecyl benzene sulfonic acid, sodium alkyl naphthalene, sodium dialkyl sulfosuccinate, sodium alkyl diphenylether disulfonate, potassium sulfonate of alkylphosphate, sodium polyoxyethylene lauryl ether sulfate, sodium polyoxyethylene alkyl ether sulfate, and triethanol amine polyoxyethylene alkylether sulfate.

7. A process in accordance with claim 1 wherein the cationic surfactant is selected from the group consisting of dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, and dodecylbenzyl triethyl ammonium chloride.

8. A process in accordance with claim 1 wherein the emulsion or latex contains water.

9. A process in accordance with claim 8 wherein the nonionic surfactant is dialkylphenoxypoly(ethyleneoxy) ethanol.

10. A process in accordance with claim 8 wherein the pigment is selected from the group consisting of carbon black, yellow, green, red, cyan, magenta, blue, orange and violet.

11. A process in accordance with claim 1 wherein the styrene-based shell is generated by the addition of styrene monomer, and acrylic acid monomer to a polyester emulsion containing an ionic surfactant utilizing a mixture of potassium persulfate and sodium bisulfite as the polymerization initiators.

12. A process in accordance with claim 1 wherein the resultant toner is then collected by cooling the mixture to about 25° C. and isolation is by filtration.

13. A process in accordance with claim 1 wherein there results a toner comprised of coalesced particles of pigment and submicron resin particles comprised of a polyester core with a styrene based shell, and wherein the styrene based shell resin is selected from the group consisting of polystyrene-acrylic acid and polystyrene-methacrylic acid, and the polyester core resin is selected from the group consisting of poly(ethylene-terephthalate), poly(propylene-diethylene terephthalate), poly(propylene-terephthalate), copoly(propylene-diethylene terephthalate)-copoly(propylene-5-sulfoisophthalate, sodium salt), poly(bisphenol A-fumarate), poly(bisphenol A-terephthalate), copoly(bisphenol A-terephthalate-copoly(bisphenol A-fumarate), poly(hexylene terephthalate), poly(neopentyl-terephthalate), and copoly(neopentyl-terephthalate)-copoly-(neopentyl-5-sulfoisophthalate).

14. A process in accordance with claim 1 wherein the pigment is selected from the group consisting of carbon black, yellow, green, red, cyan, magenta, blue, orange and violet.

15. A process in accordance with claim 1 wherein said toner compositions obtained possess a volume average particle diameter of from about 1 to about 10 microns, and a narrow GSD of from about 1.16 to about 1.26.

16. A process for the preparation of a toner comprising:

(i) preparing a latex or emulsion resin comprised of a polyester core encapsulated within a styrene resin shell by heating said polyester emulsion containing an anionic surfactant with a mixture of monomers of styrene and acrylic acid in the presence of ammonium persulfate, potassium persulfate or sodium bisulfite;

(ii) adding a pigment dispersion, which dispersion is comprised of a pigment, a cationic surfactant, and optionally a charge control agent;

(iii) heating the resulting blend below the glass transition temperature (Tg) of the resin to form toner size aggregates; and (iv) heating said aggregates above the glass transition temperature (Tg) of the resin; followed by cooling and isolating the toner.

17. A process for the preparation of a toner comprising:

(i) preparing a latex or emulsion resin comprised of a polyester core encapsulated within a styrene resin shell by heating said polyester emulsion containing an anionic surfactant with a mixture of monomers of styrene and acrylic acid in the presence of persulfate or persulfite;

(ii) adding a pigment dispersion, which dispersion is comprised of a pigment, a cationic surfactant, and optionally a charge control agent;

(iii) heating the resulting blend below the glass transition temperature (Tg) of the resin to form toner size aggregates; and (iv) heating said aggregates above the glass transition temperature (Tg) of the resin; followed by cooling and isolating the toner.

18. A process in accordance with claim 11 wherein said mixture contains from about 1 to about 99 weight percent of persulfite, and from about 99 to about 1 weight percent of bisulfite.

* * * * *